US007681759B2

(12) United States Patent
Andrews

(10) Patent No.: US 7,681,759 B2
(45) Date of Patent: Mar. 23, 2010

(54) FLUID-DISPENSING APPARATUS WITH CONTROLLED TEAR-OFF

(75) Inventor: Peter Andrews, Durham, NC (US)

(73) Assignee: Cree, Inc., Durham, NC (US)

( * ) Notice: Subject to any disclaimer, the term of this patent is extended or adjusted under 35 U.S.C. 154(b) by 951 days.

(21) Appl. No.: 11/138,704

(22) Filed: May 26, 2005

(65) Prior Publication Data

US 2006/0266766 A1 Nov. 30, 2006

(51) Int. Cl.
*B67D 5/30* (2006.01)
*B01L 3/02* (2006.01)

(52) U.S. Cl. ..... 222/14; 422/99; 422/100

(58) Field of Classification Search ..... 141/89, 141/90, 91; 222/14; 422/70, 99, 100
See application file for complete search history.

(56) References Cited

U.S. PATENT DOCUMENTS

| | | | | | |
|---|---|---|---|---|---|
| 3,552,212 | A * | 1/1971 | Ohlin | 141/90 |
| 3,601,162 | A * | 8/1971 | Page | 141/90 |
| 3,842,680 | A * | 10/1974 | Vollick et al. | 73/864.22 |
| 4,871,682 | A * | 10/1989 | Mazza | 436/179 |
| 4,911,212 | A * | 3/1990 | Burton | 141/90 |
| 5,226,565 | A * | 7/1993 | Hladis et al. | 222/148 |
| 5,408,891 | A * | 4/1995 | Barber et al. | 73/864.22 |
| 5,506,142 | A * | 4/1996 | Mahaffey et al. | 436/49 |
| 5,558,837 | A * | 9/1996 | Tsukishima | 422/99 |
| 5,650,122 | A * | 7/1997 | Harris et al. | 422/81 |
| 5,738,728 | A * | 4/1998 | Tisone | 118/638 |
| 6,322,337 | B1 | 11/2001 | Bensley et al. | 417/519 |
| 6,668,877 | B2 * | 12/2003 | Fehland et al. | 141/70 |
| 6,737,022 | B1 * | 5/2004 | Sutton et al. | 422/70 |
| 7,186,378 | B2 * | 3/2007 | Dunfee | 422/63 |
| 7,294,309 | B1 * | 11/2007 | Goldberg et al. | 422/100 |
| 2003/0066546 | A1 * | 4/2003 | Bibeault et al. | 134/21 |
| 2007/0012377 | A1 * | 1/2007 | Popplau | 141/89 |
| 2007/0079890 | A1 * | 4/2007 | Bauer et al. | 141/91 |

OTHER PUBLICATIONS

"Metering Pump offers sub-microliter dispensing", Fluid Metering, Inc., FMI, ThomasNet Industrial News Room, Dec. 2004. (4 pages).
Szuch, Mike, "Breadth of Dispensing Technologies Offers a Wide Variety of Conformal Coating Processing Capabilities", IMAPS SoCal, Pasadena, CA, May 2004. (13 pages).
Ivek Precision Liquid Metering, Dispensing & Process, http:/www.ivek.com/small.vol.disp.nox.html.

* cited by examiner

*Primary Examiner*—Timothy L Maust
(74) *Attorney, Agent, or Firm*—Myers Bigel Sibley & Sajovec

(57) ABSTRACT

Fluid-dispensing apparatus include a fluid-dispensing needle. A gas discharge member is positioned proximate a dispensing end of the needle that is configured to direct a gas towards a fluid tear-off position below the dispensing end of the needle. A controller controls discharge of the gas by the gas discharge member to control dispensing of fluid from the needle. The dispensing control may control an amount of fluid dispensed from the needle and/or tailing off of fluid dispensed from the needle. The amount of fluid dispensed from the needle may be a microliter range volume of a viscous fluid.

24 Claims, 5 Drawing Sheets

FLUID-DISPENSING APPARATUS WITH CONTROLLED TEAR-OFF

BACKGROUND OF THE INVENTION

This invention relates to fluid-dispensing apparatus and methods for using the same, and more particularly to dispensing small volumes of fluid.

The ability to deliver small volumes of fluids accurately is important in a variety of industries. For example, a variety of different fabrication operations in the semiconductor industry utilize sub-microliter control of fluid dispensing. Such uses may require accurate, repeatable and rapid dispensing of precise amounts of fluids. If these requirements are not met, it may adversely impact the yield of the fabrication process.

One example of sub-microliter dispensing of fluids is in the fabrication of semiconductor light-emitting devices. It is known to provide semiconductor light-emitting device type light sources in packages that may provide protection, color selection, focusing and the like for light emitted by the light-emitting device. For example, the light-emitting device may be a light-emitting diode ("LED"). As shown in the example of FIG. 1, a power LED package 100 generally includes a substrate member 102 on which a light-emitting device 103 is mounted. The light-emitting device 103 may, for example, include an LED chip/submount assembly 103*b* mounted to the substrate member 102 and an LED 103*a* positioned on the LED chip/submount assembly 103*b*. The substrate member 102 may include traces or metal leads for connecting the package 100 to external circuitry. The substrate 102 may also act as a heatsink to conduct heat away from the LED 103 during operation.

A reflector, such as the reflector cup 104, may be mounted on the substrate 102 and surround the light-emitting device 103. The reflector cup 104 illustrated in FIG. 1 includes an angled or sloped lower sidewall 106 for reflecting light generated by the LED 103 upwardly and away from the LED package 100. The illustrated reflector cup 104 also includes upwardly extending walls 105 that may act as a channel for holding a lens in the LED package 100 and a horizontal shoulder portion 108.

As illustrated in FIG. 1, after the light-emitting device 103 is mounted on the substrate 102, a microliter quantity of an encapsulant material 107, such as liquid silicone gel, is dispensed into an interior reflective cavity 109 of the reflector cup 104. The interior reflective cavity 109 illustrated in FIG. 1 has a bottom surface defined by the substrate 102 to provide a closed cavity capable of retaining a liquid encapsulant material 107 therein. As further shown in FIG. 1, when the encapsulant material 107 is dispensed into the cavity 109, it may wick up the interior side of the sidewall 105 of the reflector cup 104, forming the illustrated concave meniscus.

In dispensing the encapsulant material 107, a bead of the material is typically formed on a dispensing needle and then contacted to surfaces of the reflective cavity 109 and the light-emitting device 103 therein. When the needle is withdrawn, the surface tension between the encapsulant material 107 and surfaces within the reflective cavity 109 and gravity cause the encapsulant material 107 to tear-off from the dispensing needle and remain in the reflective cavity 109.

While this surface tension controlled dispensing of the encapsulant material 107 may be very accurate under uniform conditions, a variety of factors may adversely impact the accuracy of the process and the amount of fluid dispensed. For example, different surfaces within the reflective cavity 109 may have different surface tension characteristics based on coatings on the surfaces, shape characteristics of the surfaces and variations in where the encapsulant material 107 is initially placed in the reflective cavity 109. In addition, variations in the characteristics of the encapsulant material 107 may also affect the amount of fluid dispensed. For example, the encapsulant material 107 is typically subject to varying viscosity and stringiness characteristics over time (due, for example, to partial curing) or across different temperature conditions. Stringiness characteristics, such as varying tail properties, may change with variations in temperature, humidity or the like or may change over time. Thus, the tear-off point and the volume of fluid dispensed may vary.

Other approaches to sub-microliter control of dispensing of fluids include the use of metering pumps particularly designed for accurate dispensing of small volumes of fluid. In addition, specially designed small volume dispensing nozzles (needles) are known that may be used with such precision pump systems.

SUMMARY OF THE INVENTION

Embodiments of the present invention provide fluid-dispensing apparatus including a fluid-dispensing needle. A gas discharge member is positioned proximate a dispensing end of the needle that is configured to direct a gas towards a fluid tear-off position below the dispensing end of the needle. A controller controls discharge of the gas by the gas discharge member to control dispensing of fluid from the needle. The dispensing control may control an amount of fluid dispensed from the needle and/or tailing off of fluid dispensed from the needle. The amount of fluid dispensed from the needle may be a microliter range volume of a viscous fluid.

In further embodiments of the present invention, the gas discharge member includes a pair of gas discharge nozzles positioned on opposite sides of the needle. The apparatus may further include a movable needle mount member. The needle may be positioned in the needle mount member and the gas discharge nozzles may be coupled thereto to move with the needle. The controller may be configured to control movement of the needle mount member between a dispense position and a retracted position.

In other embodiments of the present invention, the controller is configured to activate the gas discharge member after the needle mount member begins movement from the dispense position towards the retracted position. The controller may be configured to provide a pulse of gas from the gas discharge member to tear-off a liquid dispensed from the needle. The controller may be configured to provide a pattern of gas flow from the gas discharge member to tear-off a liquid dispensed from the needle. The pattern may be an amplitude and/or a frequency pattern.

In further embodiments of the present invention, the gas discharge nozzles are air knifes. The air knifes may each be positioned above a plane extending orthogonally to a direction of movement of the needle mount member between the dispense and retracted positions that extends from the dispensing end of the needle and the fluid tear-off position may be below the plane.

In yet other embodiments of the present invention, a sensor is positioned proximate the fluid tear-off position that is configured to detect tearing of the fluid and the controller is configured to control discharge of the gas responsive to the sensor. The sensor may be an optical and/or a pressure sensor and the controller may be configured to stop discharge of the gas responsive to the sensor detecting tearing of the fluid. The sensor in some embodiments is a pressure sensor and the controller is configured to increase an amplitude of the gas flowing from the gas discharge member until tearing of the fluid is detected by the sensor.

In further embodiments of the present invention, the controller is configured to control discharge of the gas by the gas discharge member to limit wicking of the fluid along an outer sidewall of the needle. The gas discharge nozzles may be positioned below a plane extending orthogonally to a direction of movement of the needle mount member between the dispense and retracted positions that extends from the dispensing end of the needle and the gas discharge nozzles may be aligned in opposing relationship at a height defined by the fluid tear-off position. The controller may be configured to provide sub-microliter control of dispensing of the microliter range volume of the viscous fluid using the gas discharge member.

In yet other embodiments of the present invention, sub-microliter dispensing apparatus are provided for dispensing a viscous encapsulant material into a semiconductor light-emitting device reflector cup with a semiconductor light-emitting device therein. The apparatus includes a movable needle mount member configured to move between a lower dispense position proximate the reflector cup and an upper retracted position. An encapsulant dispensing needle is mounted to the needle mount member. A gas discharge nozzle is positioned proximate a dispensing end of the needle and is configured to direct a gas towards a fluid tear-off position below the dispensing end of the needle. A controller is provided that is configured to activate flow of the gas after a sub-microliter amount of the encapsulant material has been dispensed in the reflector cup from the needle to control tear-off of the sub-microliter amount of the encapsulant material from the needle. The controller may be configured to activate flow of the gas responsive to the needle mount member reaching a tear height position between the dispense position and the retracted position after the sub-microliter amount of the encapsulant material has been dispensed in the reflector cup.

In other embodiments of the present invention, in the tear height position, a sub-microliter range volume portion of the microliter amount of the encapsulant material is positioned in a necked portion of the encapsulant material extending from the needle. In such embodiments, the controller may be configured to control tear off of the sub-microliter range volume portion to provide sub-microliter volume control of dispensing of the microliter amount of the encapsulant material using the gas discharge nozzle.

In further embodiments of the present invention, methods of dispensing a fluid include ejecting the fluid from a fluid-dispensing needle and activating a gas discharge member positioned proximate a dispensing end of the needle to tear-off the ejected fluid from the needle at a fluid tear-off position to control a volume of the fluid dispensed from the needle. Ejecting the fluid may be preceded by moving the needle to a lower dispensing position and activating the gas discharge member may be preceded by moving the needle to an intermediate position of the needle above the dispensing position. The needle may be moved to a retracted position above the intermediate position after the volume of the fluid is dispensed from the needle.

In other embodiments of the present invention, the volume of the fluid is a microliter range volume of a viscous fluid and ejecting the fluid from the dispensing needle includes contacting a surface of the ejected fluid to a surface of a receptacle into which the fluid is being dispensed. The surface of the receptacle may include regions having different surface tensions. The fluid may be, for example, an encapsulant material and the receptacle may be, for example, a reflector cavity of a semiconductor light-emitting device.

In further embodiments of the present invention, activating the gas discharge member includes activating the gas discharge member after the needle begins movement from the lower dispensing position towards the intermediate position. Activating the gas discharge member may include providing a pulse of gas from the gas discharge member to tear-off the ejected fluid. Activating the gas discharge member may include providing a pattern of gas flow from the gas discharge member to tear-off the ejected fluid. The pattern may be an amplitude and/or a frequency pattern.

In yet other embodiments of the present invention, methods of dispensing an encapsulant material into a reflector cavity of a semiconductor light-emitting device include moving an encapsulant material dispensing needle to a lower dispensing position. The encapsulant material is moved from the needle to contact a surface of the reflector cavity with the needle in the lower dispensing position. The needle is moved from the lower dispensing position to an intermediate position of the needle above the lower dispensing position without tearing-off the encapsulant material from the needle. A gas discharge member positioned proximate a dispensing end of the needle is activated to tear-off the encapsulant material from the needle at a fluid tear-off position to control a volume of the encapsulant material dispensed into the reflector cavity. The surface of the reflector cavity may include regions having different surface tensions. The encapsulant material may then be cured in the reflector cavity.

In yet further embodiments of the present invention, in the intermediate position, a sub-microliter range volume portion of the encapsulant material moved from the needle is positioned in a necked portion of the encapsulant material moved from the needle. Activating the gas discharge member in such embodiments may include activating the gas discharge member to control tear off of the sub-microliter range volume portion to provide sub-microliter volume control of dispensing of the volume of the encapsulant material dispensed into the reflector cup.

DETAILED DESCRIPTION

Figure 1:
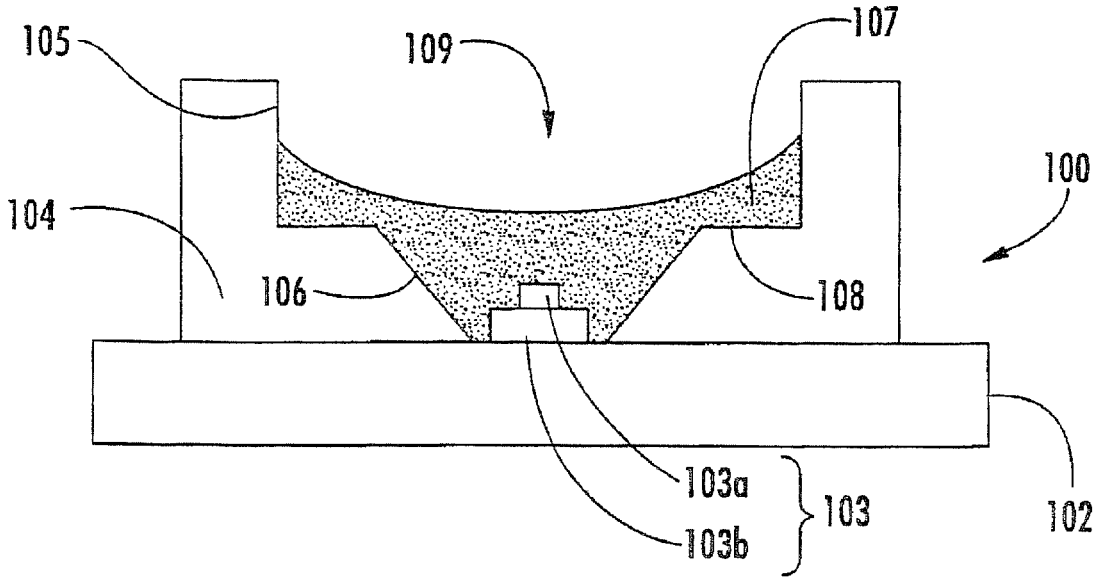
FIG. 1 PRIOR ART
FIG. 1 is a cross-sectional side view illustrating a conventional light-emitting device package.

The present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity. Like numbers refer to like elements throughout.

It will be understood that when an element such as a layer, region or substrate is referred to as being "on" another element, it can be directly on the other element or intervening elements may also be present. It will be understood that if part of an element, such as a surface, is referred to as "inner," it is farther from the outside of the device than other parts of the element. Furthermore, relative terms such as "beneath" or "overlies" may be used herein to describe a relationship of one layer or region to another layer or region relative to a substrate or base layer as illustrated in the figures. It will be understood that these terms are intended to encompass different orientations of the device in addition to the orientation depicted in the figures. Finally, the term "directly" means that there are no intervening elements. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Various embodiments of the present invention for dispensing a fluid will be described herein. More particularly, apparatus and methods according to various embodiments of the present invention will be described with reference to examples involving packaging a semiconductor light-emitting device 103 including dispensing an encapsulant material into a reflector cavity of a packaged semiconductor light-emitting device. As used herein, the term semiconductor light-emitting device 103 may include a light-emitting diode, laser diode and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive layers. In some embodiments, ultraviolet, blue and/or green light-emitting diodes ("LEDs") may be provided. Red and/or amber LEDs may also be provided. The design and fabrication of semiconductor light-emitting devices 103 are well known to those having skill in the art and need not be described in detail herein.

For example, the semiconductor light-emitting device 103 may be gallium nitride-based LEDs or lasers fabricated on a silicon carbide substrate such as those devices manufactured and sold by Cree, Inc. of Durham, N.C.

Various embodiments of the present invention as will be described herein incorporate a directed-pressurized gas stream to control dispensing tear-off during fluid-dispensing. Such approaches may allow control of the tear-off point of the dispense fluid, thereby allowing more accurate control of the volume dispensed. Volume dispensing of liquid to viscous materials with sub-microliter control of volumes may be extremely difficult. One of the major obstacles in such dispensing is that the material, when dispensed from a needle type arrangement, may have a large source of variability in volume. This variation may be heavily dependent in current dispensing technologies on the tear-off of the dispensed material from the needle tip. In some embodiments of the present invention, positive control of the breaking/tear point of the material "tail" may be provided that may be superior to current methodologies, which generally depend primarily on time/gravity/x-y-z travel to influence the tear-off.

Various embodiments of the present invention may also significantly improve throughput on production lines by allowing quick "pinching" of the tail of material that is formed after dispensing for some materials. Current production equipment typically has to travel relatively large differences, relative to a diameter of the tail, in a z-axis direction after dispensing to get the tail of fluid to break controllably. In addition, the travel in the z-axis direction may be generally slow to allow time for necking of the dispensed material due to gravity flow, adhesion in surface tension of materials. By actively directing gas streams at the material, the necking may be effectively sped up and the breaking point may be controlled.

In some embodiments of the present invention, the apparatus and methods may direct the tail of material from snapping randomly down into the dispensed material (referred to as "tailing off" herein) and, likewise, may limit or prevent snapping up onto the dispensed needle itself. This may control volume placement and control needle "wicking" so that dispensing from the needle may be more repeatable. Such controlled dispensing of the fluid may limit placing the dispensed material on undesirable locations, such as on wire bonds or the like during semiconductor light-emitting device manufacturing. Such control may be particularly beneficial with fluid adhesives and the like, which may be more subject to such tailing off problems than fluid encapsulant materials.

As will further be described herein, various embodiments may include a single pulsed air knife generating a high speed, small volume puff of gas "sharp" enough to sever and/or speed breaking of a tail of a material being dispensed. The aiming and repeatability characteristics of the gas stream may generate improved volume control. Other embodiments include a multiple-nuzzle approach where gas streams may be, for example, opposed to pinch the tail and the opposing turbulent effect may be utilized to generate control over a volume dispensed. Yet further embodiments may utilize a pulsed gas air knife that utilizes the pulsating action in either frequency or amplitude of pulses (or both) of a gas stream to control the tear-off point.

Figure 2:
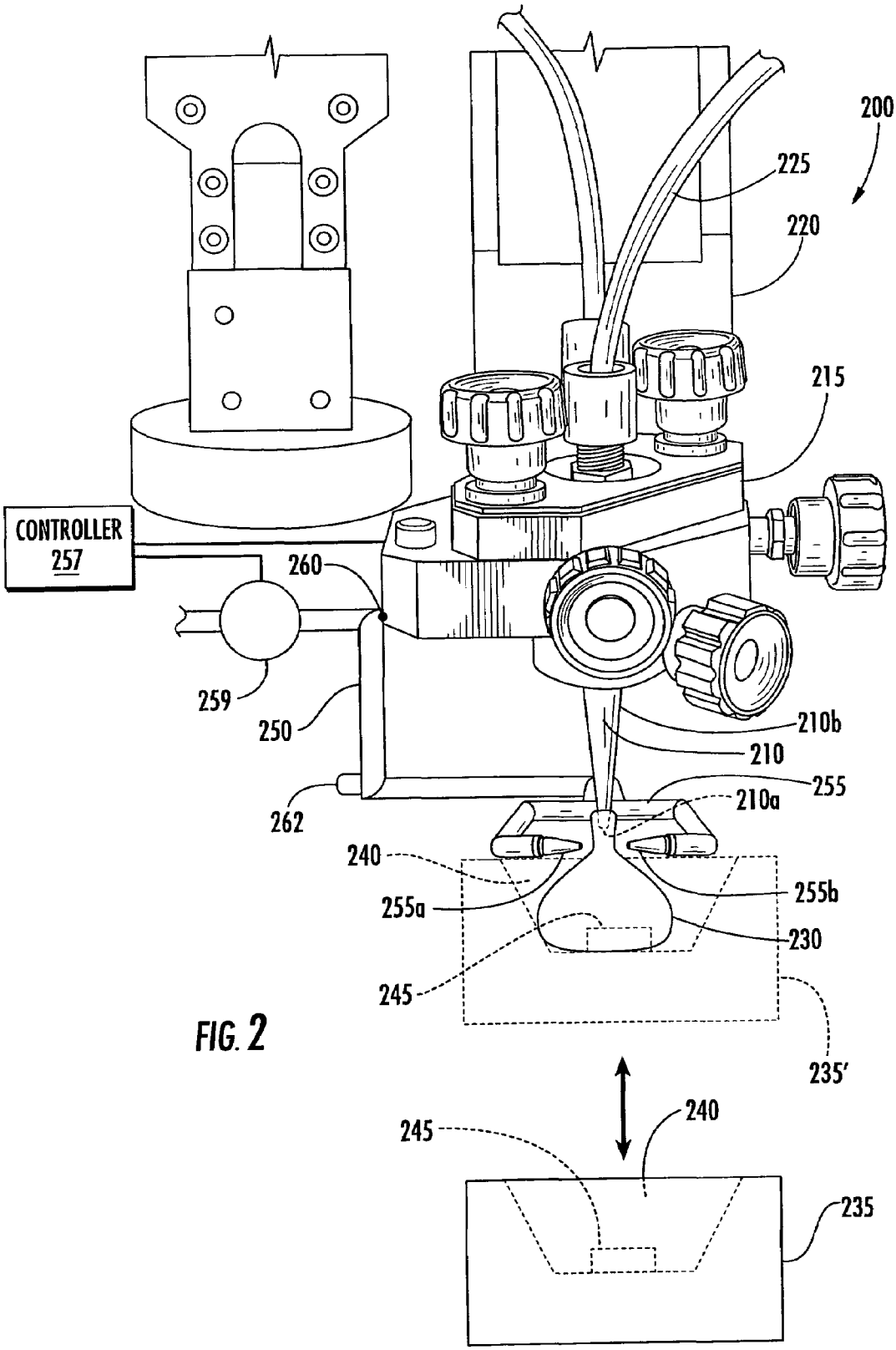
FIG. 2 is a perspective view illustrating a fluid-dispensing apparatus according to some embodiments of the present invention.

Referring now to FIG. 2, apparatus and methods for dispensing a fluid, in particular an encapsulant material, into a reflector cavity of a semiconductor light-emitting device will now be described. For the embodiments illustrated in FIG. 2 the fluid dispensing apparatus 200 includes a fluid-dispensing needle 210 that is connected to a movable needle mount member 215. The needle mount member 215 is shown coupled to a frame 220. The needle mount member 215 may be configured to move relative to the frame 220 or to be substantially rigidly mounted on the frame 220.

Movement of the needle mount member 215 in various embodiments of the present invention, which movement herein shall refer to relative movement of the needle mount member with respect to a reflector 235 or other receptacle that is to receive a dispensed fluid (i.e., the reflector 235 may be physically moved relative to a fixed needle mount member 215 to provide movement of the needle mount member 215 and needle 210), is in a z-axis direction corresponding to up and down directions in FIG. 2. It will be understood that, in some embodiments of the present invention, the needle mount member 215 may also be movable in x and y directions relative to the reflector 235. A fluid delivery member 225 is also shown in the embodiments of FIG. 2 that is configured to deliver the fluid to the fluid-dispensing needle 210 through the needle mount member 215.

Also shown in the embodiments of FIG. 2 is the reflector 235 with a semiconductor light-emitting device 245 positioned in a reflector cavity 240 of the reflector 235. The reflector 235 is illustrated at a position where the needle mount member 215 is in a retracted position, displaced along the z-axis from the reflector 235. The reflector 235 is further illustrated in dotted line as a reflector 235' at a dispense position relative to the needle mount member 215.

Also shown in the embodiments of FIG. 2 is a gas discharge member 255 positioned approximate a dispensing end 210*a* of the needle 210. The gas discharge member 255 is configured to direct a gas towards a fluid tear-off position 265 (FIG. 3) below the dispensing end 210*a* of the needle 210. A controller 257 controls discharge of gas by the gas discharge member 255 to control an amount of fluid dispensed from the needle 210. For example, as illustrated in the embodiments of FIG. 2, the controller 257 may be coupled to control a valve 259 to turn on and off flow of gas to the gas discharge member 255 through a gas supply line 250.

As shown in the embodiments of FIG. 2, the gas discharge member 255 may be coupled to the needle mount member 215 at a connection 260, such as a bolt, weld, adhesive or the like, so as to move with the needle mount member 215. Thus, the gas discharge member 255 may maintain position and move with the needle 210. The controller 257 may be configured to control movement of the needle mount member 215 between a retracted position and a dispense position with reference to the reflector 235, 235' as respectively shown in FIG. 2. Note that, while the movement is shown with reference to the reflector 235 being moved in FIG. 2, the movement of the needle mount member 215 between the two positions may be provided by moving the needle mount member 215 (either with or along the frame 220) and/or by moving the reflector 235, 235' to provide the desired relative movement of the needle mount member 215 between a dispense and a retracted position.

As shown in FIG. 2, in some embodiments of the present invention, the gas discharge member 255 includes a pair of gas discharge nozzles 255*a*, 255*b* positioned on opposite sides of the needle 210.

The controller 257 may be configured to activate the gas discharge member 255 after the needle mount member 215 begins movement from the dispense position toward the retracted position, either by movement of the reflector 235 or of the needle mount member 215 itself.

A variety of different approaches for delivering the gas from the gas discharge member 255 may be utilized in various embodiments of the present invention. In some embodiments, a pulse of gas from the gas discharge member is provided by the controller 257 to tear-off a liquid 230 dispensed from the needle 210. In other embodiments, the controller 257 may be configured to provide a pattern of gas flow from the gas discharge member 255 to tear-off a liquid 230 dispensed from the needle 210. The pattern may be an amplitude and/or a frequency pattern variation in the gas discharge.

Also shown in the embodiments of FIG. 2 is a sensor 262 configured to detect tearing of the liquid (fluid) 230. The sensor 262 may be positioned proximate the tear-off position of the fluid 230 to detect tearing of the fluid. The controller 257 may be configured to control discharge of the gas through the gas discharge member 255 responsive to the sensor 262.

The sensor, in some embodiments of the present invention, is an optical sensor positioned proximate the fluid tear-off position 265 (FIG. 3) so as to detect tear-off of the fluid either based on reflected light from the fluid at the tear-off point or, where a sensor source is positioned opposite a sensor optical receiver on opposite sides of the fluid 230, through transmitted light detection. In other embodiments of the present invention, the sensor 262 is a pressure sensor configured to detect a pressure characteristic in the supply line 250 or the gas discharge member 255 so as to detect a change in pressure characteristic transmitted back through the gas itself when tear-off of the liquid 230 occurs.

The controller 257 may be configured to stop discharge of gas from the gas discharge member 255 responsive to the sensor 262 detecting tearing of the fluid 230. In other embodiments of the present invention, the controller 257 is configured to progressively increase an amplitude of gas flowing from the gas discharge member 255 until tearing of the fluid is detected by the sensor 262.

In some embodiments of the present invention, the gas discharge member, in addition to being used to control tear-off of the liquid 230, is utilized to control wicking of the fluid 230 along an outer sidewall 210*b* of the needle 210. More particularly, the controller 257 may activate flow of gas to the gas discharge member 255 during, for example, dispensing of the liquid 230 and placement of the liquid 230 in the cavity 240 so as to prevent the liquid 230 from being pushed or wicked up the outer sidewall 210*b* of the needle 210. Control of such wicking up the outer sidewall 210*b* of the needle 210 by the fluid 230 may further improve the consistency of the amount of fluid 230 dispensed during the dispensing operation. It may also help maintain a clean outer surface of the needle 210 during repeated dispensing operations.

In the embodiments illustrated in FIG. 2, the gas discharge nozzles 255*a*, 255*b* of the gas discharge member 255 are positioned below a plane extending orthogonally to the z-axis direction of movement of the needle mount member 215 between the dispensed and retracted positions, the plane extending from the dispensing end 210*a* of the needle 210. In particular, the gas discharge nozzles 255*a*, 255*b* are aligned in opposing relationship at a height defined by a desired fluid tear-off position of the fluid 230 below the dispensing end 210*a* of the needle 210.

Figure 3:
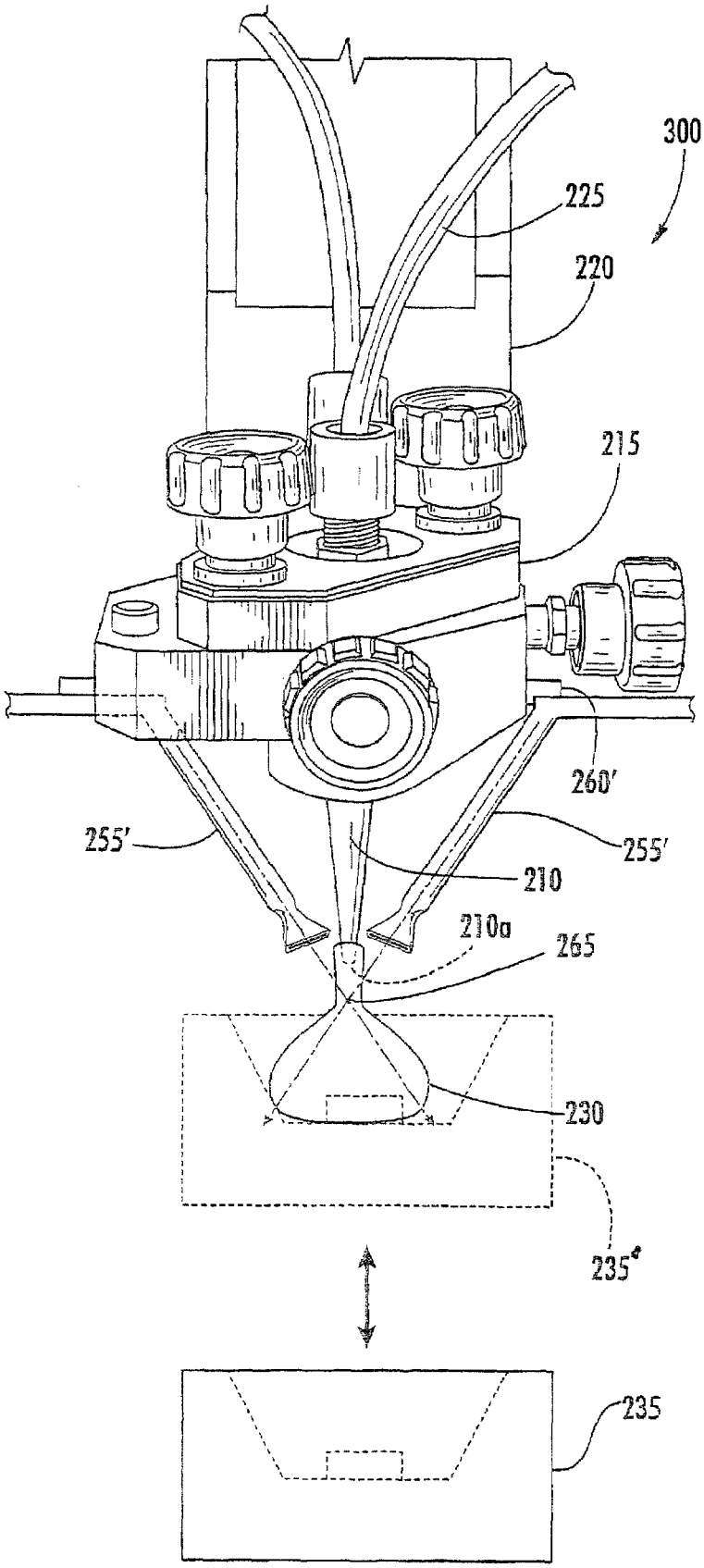
FIG. 3 is a perspective view illustrating a fluid-dispensing apparatus according to further embodiments of the present invention.

Further embodiments of a fluid dispensing apparatus 300 according to the present invention will now be described with reference to the perspective view illustration of FIG. 3. Like numbered items in FIG. 3 correspond to those previously described in reference to FIG. 2 and will not be further described herein with reference to FIG. 3 except to the extent that they differ for the embodiments shown in FIG. 3. Also, for reference purposes, the reflector 235 is shown in a retracted position 235 and in an intermediate (or tear-off) position 235' in FIG. 3. For the embodiments illustrated in FIG. 3, the gas discharge member 255 is shown as a pair of air knives 255', each of which is positioned above a plane extending orthogonally to a direction of movement of the needle mount member 215 relative to the reflector 235 between the dispense, retracted and intermediate positions. The reference plane extends from the dispensing end 210*a* of the needle 210 (in other words, the air knives 255' are positioned above a plane defined by the dispensing end 210*a* of the needle 210). The fluid tear-off position 265 is also shown below the dispensing end 210*a* of the needle 210 in the embodiments of FIG. 3.

Figure 4:
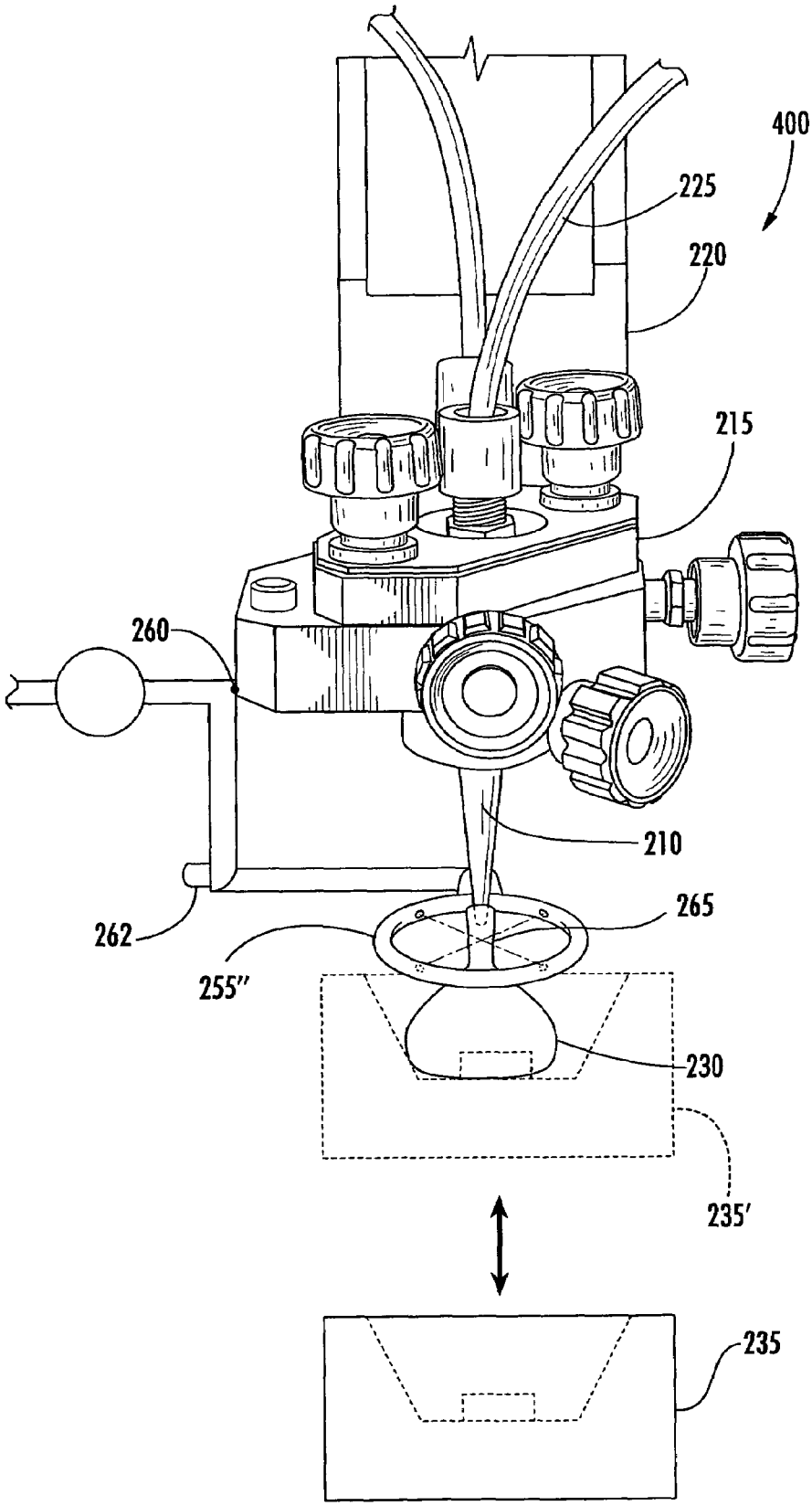
FIG. 4 is a perspective view illustrating a fluid-dispensing apparatus according to other embodiments of the present invention.

Further embodiments of a fluid-dispensing apparatus 400 according to the present invention are illustrated in FIG. 4. As shown in the perspective view illustration of FIG. 4, the gas discharge member 255" may be a circumferential arrangement nozzle 255" surrounding the needle 210. As shown in FIG. 4, a sparger tube is utilized as the gas discharge member 255" to direct the flow of a gas, such as air, towards a fluid tear-off point 265.

As described above with reference to a sub-microliter dispensing apparatus 200, 300, 400 for dispensing a viscous encapsulant material into a cavity of a reflector with a semiconductor light-emitting device therein, an encapsulant dispensing needle with a gas discharge nozzle positioned proximate a dispensing end thereof may be controlled by a controller to control tear-off, with sub-microliter control, of the encapsulant material from the needle, for example, by activating a gas flow when the needle mount member reaches a tear height position relative to the reflector. It will be understood that, as used herein, references to movement of the needle and needle mount member are references to relative movement of the needle and needle mount member with reference to the reflector 235. In other words, the movement between positions of the needle and needle mount member may be accomplished either by physical displacement of the reflector 235 and/or of the needle mount member 215, with either variant being referred to herein by reference to movement of the needle mount member to different positions.

Embodiments of methods of dispensing of fluid according to the present invention will now be described with reference to the flowchart illustration of FIG. 5. For the embodiments illustrated in FIG. 5, a fluid-dispensing needle is moved to a lower dispensing position (Block 500). The fluid is then ejected (moved) from the fluid-dispensing needle (Block 505). For the illustrated embodiments of FIG. 5, after ejecting fluid from the needle at Block 505, the needle is moved to an intermediate or tear-off position (Block 510). A gas discharge member positioned proximate the dispensing end of the needle is activated to tear-off the ejected fluid from the needle at a fluid tear-off position to control the volume of the fluid dispensed from the needle (Block 515). In some embodiments of the present invention, after tear-off of the fluid, the needle may be moved to a retracted position, that may be above the intermediate position, after the fluid is dispensed from the needle.

Operations related to ejecting or moving a fluid, such as an encapsulant material, from the needle at Block 505 may include contacting a surface of the ejected/moved fluid to a surface of a receptacle, such as a reflector cavity, into which the fluid is being dispensed. As noted previously, the surface of the receptacle to which the ejected fluid is contacted may include regions having different surface tensions. For example, reflective sidewalls may be coated with a reflective material having one surface tension characteristic while a semiconductor light-emitting device positioned within the cavity may have different characteristics.

While described above for embodiments where the gas discharge is activated after the needle is moved to an intermediate position, in other embodiments of the present invention, the gas discharge member may be activated after the needle begins movement from the lower dispensing position towards an intermediate or tear-off position without waiting until the intermediate position is reached. Furthermore, in some embodiments, gas may be flowed from the gas discharge member during the dispensing operation itself at some rate to control wicking of the dispensed encapsulant material or other fluid up an outer surface of the dispensing needle during the fluid-dispensing operation.

In additional embodiments of the present invention, where the fluid is an encapsulant material and is being placed in a reflector cavity of a semiconductor light-emitting device, operations following dispensing of the fluid may include curing the encapsulant material in the reflector cavity.

Figure 5:
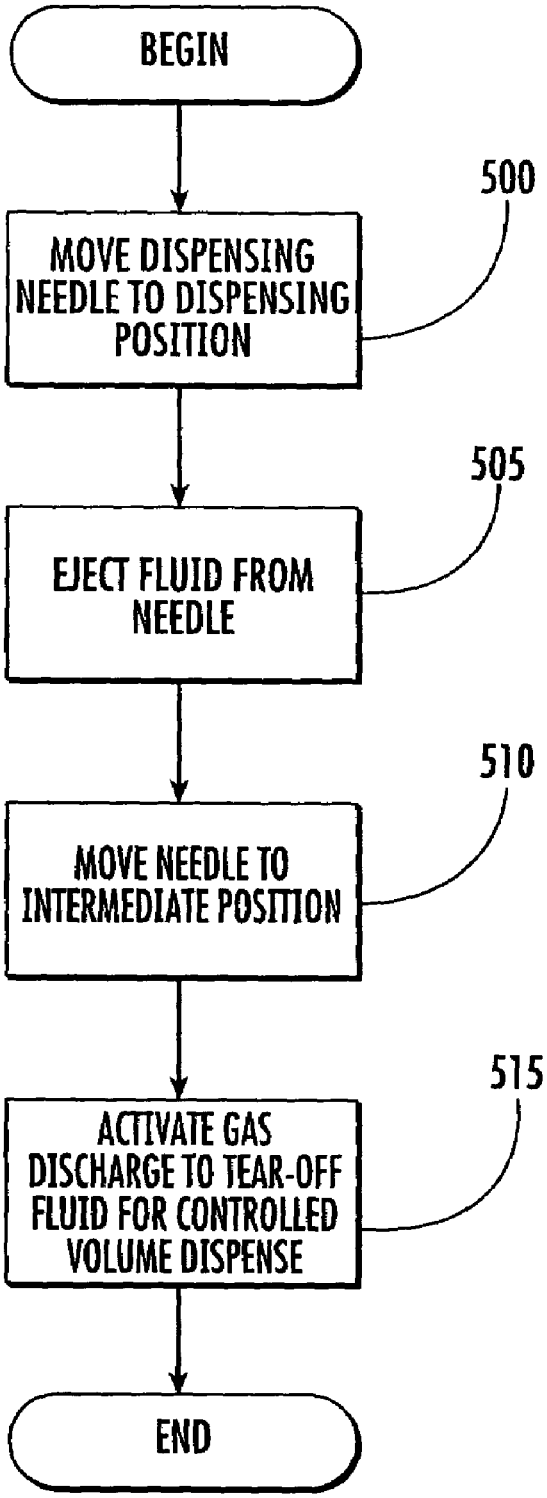
FIG. 5 is a flowchart illustrating operations for dispensing a fluid according to some embodiments of the present invention.

The flowchart of FIG. 5 illustrates the functionality and operation of possible implementations of methods for dispensing a fluid according to some embodiments of the present invention. It should be noted that, in some alternative implementations, the acts noted in describing the figures may occur out of the order noted in the figures. For example, two blocks/operations shown in succession may, in fact, be executed substantially concurrently, or may be executed in the reverse order, depending upon the functionality involved.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A fluid-dispensing apparatus, comprising:

a fluid-dispensing needle that is configured to eject fluid from within the fluid-dispensing needle in a first direction at a dispensing end;

a gas discharge member positioned proximate a dispensing end of the needle and configured to direct a gas in a second direction that is not parallel to the first direction and that is towards a fluid tear-off position below the dispensing end of the needle after the fluid is ejected from the needle; and a controller that controls discharge of the gas by the gas discharge member to control dispensing of fluid from the needle to provide sub-microliter control of dispensing of a microliter range volume of the fluid using the gas discharge member.

2. The apparatus of claim 1 wherein the controller is configured to control an amount of fluid dispensed from the needle.

3. The apparatus of claim 1 wherein the controller is configured to control tailing off of fluid dispensed from the needle.

4. The apparatus of claim 3 wherein the amount of fluid dispensed from the needle comprises a microliter range volume of a viscous fluid.

5. The apparatus of claim 4 wherein the gas discharge member includes a pair of gas discharge nozzles positioned on opposite sides of the needle.

6. The apparatus of claim 5 wherein the apparatus further comprises a movable needle mount member and wherein the needle is positioned in the needle mount member and the gas discharge nozzles are coupled thereto to move with the needle and wherein the controller is configured to control movement of the needle mount member between a dispense position and a retracted position.

7. The apparatus of claim 6 wherein the controller is configured to activate the gas discharge member after the needle mount member begins movement from the dispense position towards the retracted position.

8. The apparatus of claim 7 wherein the controller is configured to provide a pulse of gas from the gas discharge member to tear-off a liquid dispensed from the needle.

9. The apparatus of claim 7 wherein the controller is configured to provide a pattern of gas flow from the gas discharge member to tear-off a liquid dispensed from the needle.

10. The apparatus of claim 9 wherein the pattern comprises an amplitude and/or a frequency pattern.

11. The apparatus of claim 7 wherein the gas discharge nozzles comprise air knives.

12. The apparatus of claim 11 wherein the air knives are each positioned above a plane extending orthogonally to a direction of movement of the needle mount member between the dispense and retracted positions that extends from the dispensing end of the needle and wherein the fluid tear-off position is below the plane.

13. The apparatus of claim 7 further comprising a sensor positioned proximate the fluid tear-off position configured to detect tearing of the fluid and wherein the controller is configured to control discharge of the gas responsive to the sensor.

14. The apparatus of claim 13 wherein the sensor comprises an optical and/or a pressure sensor and wherein the controller is configured to stop discharge of the gas responsive to the sensor detecting tearing of the fluid.

15. The apparatus of claim 14 wherein the sensor comprises a pressure sensor and wherein the controller is configured to increase an amplitude of the gas flowing from the gas discharge member until tearing of the fluid is detected by the sensor.

16. The apparatus of claim 7 wherein the controller is configured to control discharge of the gas by the gas discharge member to limit wicking of the fluid along an outer sidewall of the needle.

17. The apparatus of claim 7 wherein the gas discharge nozzles are positioned below a plane extending orthogonally to a direction of movement of the needle mount member between the dispense and retracted positions that extends from the dispensing end of the needle and wherein the gas discharge nozzles are aligned in opposing relationship at a height defined by the fluid tear-off position.

18. The apparatus of claim 4 wherein the gas discharge member comprises a circumferential arrangement nozzle surrounding the needle.

19. The apparatus of claim 18 wherein the circumferential arrangement nozzle comprises a sparger tube.

20. A fluid-dispensing apparatus, comprising:

a fluid-dispensing needle that is configured to eject fluid from within the fluid-dispensing needle at a dispensing end;

a gas discharge member positioned proximate the dispensing end of the needle and configured to direct a gas towards a fluid tear-off position below the dispensing end of the needle after the fluid is ejected from the needle; and a controller that controls discharge of the gas by the gas discharge member to control dispensing of fluid from the needle, wherein the controller is configured to control tailing off of fluid dispensed from the needle, wherein the amount of fluid dispensed from the needle comprises a microliter range volume of a viscous fluid, and wherein the controller is configured to provide sub-microliter control of dispensing of the microliter range volume of the viscous fluid using the gas discharge member.

21. A microliter dispensing apparatus for dispensing a viscous encapsulant material into a semiconductor light-emitting device reflector cup with a semiconductor light-emitting device therein, the apparatus comprising:

a movable needle mount member configured to move between a lower dispense position proximate the reflector cup and an upper retracted position;

an encapsulant dispensing needle that is configured to eject the viscous encapsulant material at a dispensing end of the needle and from within the encapsulant dispensing needle that is mounted to the needle mount member;

a gas discharge nozzle positioned proximate the dispensing end of the needle and configured to direct a gas towards a fluid tear-off position below the dispensing end of the needle after the viscous encapsulant material is ejected from the needle; and a controller configured to activate flow of the gas after a microliter amount of the encapsulant material has been dispensed in the reflector cup from the needle to control tear-off of the microliter amount of the encapsulant material from the needle.

22. The apparatus of claim 21 wherein the controller is configured to activate flow of the gas responsive to the needle mount member reaching a tear height position between the dispense position and the retracted position.

23. The apparatus of claim 22 wherein, in the tear height position, a sub-microliter range volume portion of the microliter amount of the encapsulant material is positioned in a necked portion of the encapsulant material extending from the needle and wherein the controller is configured to control tear off of the sub-microliter range volume portion to provide sub-microliter volume control of dispensing of the microliter amount of the encapsulant material using the gas discharge nozzle.

24. A fluid-dispensing apparatus, comprising:

a fluid-dispensing needle that is configured to eject fluid from within the fluid-dispensing needle in a first direction at a dispensing end;

a gas discharge member positioned proximate the dispensing end of the needle and configured to direct a gas in a second direction that is not parallel to the first direction and that is towards a fluid tear-off position below the dispensing end of the needle after the fluid is ejected from the needle; and a controller that controls discharge of the gas by the gas discharge member to control dispensing of fluid from the needle.

* * * * *